US009609428B2

(12) United States Patent
Li

(10) Patent No.: US 9,609,428 B2
(45) **Date of Patent: *Mar. 28, 2017**

(54) METHOD AND DEVICE FOR AUTOMATICALLY IDENTIFYING MICROPHONE PIN AND GROUND PIN OF AUDIO INTERFACE AND ELECTRONIC SIGNATURE TOKEN

(71) Applicant: TENDYRON CORPORATION, Beijing (CN)

(72) Inventor: Dongsheng Li, Beijing (CN)

(73) Assignee: TENDYRON CORPORATION, Beijing (CN)

( * ) Notice: Subject to any disclaimer, the term of this patent is extended or adjusted under 35 U.S.C. 154(b) by 49 days.

This patent is subject to a terminal disclaimer.

(21) Appl. No.: 14/407,682

(22) PCT Filed: Jun. 13, 2013

(86) PCT No.: PCT/CN2013/077143

§ 371 (c)(1),
(2) Date: Dec. 12, 2014

(87) PCT Pub. No.: WO2013/185609

PCT Pub. Date: Dec. 19, 2013

(65) Prior Publication Data

US 2015/0156585 A1 Jun. 4, 2015

(30) Foreign Application Priority Data

Jun. 13, 2012 (CN) ..... 2012 1 0196122

(51) Int. Cl.

| | |
|---|---|
| ***H04R 3/00*** | (2006.01) |
| ***H04R 29/00*** | (2006.01) |
| ***H04R 1/10*** | (2006.01) |

(52) U.S. Cl.
CPC ..... *H04R 3/00* (2013.01); *H04R 29/004* (2013.01); *H04R 1/1041* (2013.01); *H04R 2420/05* (2013.01); *H04R 2420/09* (2013.01)

(58) Field of Classification Search
None
See application file for complete search history.

(56) References Cited

U.S. PATENT DOCUMENTS 5,498,971 A 3/1996 Turnbull et al.
5,703,512 A 12/1997 McClure
(Continued)

FOREIGN PATENT DOCUMENTS

CN 101662210 3/2010
CN 101783986 7/2010
(Continued)

OTHER PUBLICATIONS

WIPO, International Search Report for PCT/CN2013/077143, Sep. 19, 2013.

*Primary Examiner* — Joseph J Nguyen
*Assistant Examiner* — Kenny Truong
(74) *Attorney, Agent, or Firm* — Kile Park Reed & Houtteman LLC

(57) ABSTRACT

A method and a device for automatically identifying a microphone pin and a ground pin of an audio interface and an electronic signature token are provided. The method comprises: not implementing an identification operation on the first pin and the second pin of the audio interface when an absolute value of a voltage difference between the first pin and the second pin is less than a first threshold; and determining a type of each of the first pin and the second pin according to a sign of the voltage difference between the first pin and the second pin when the absolute value of the voltage difference is greater than or equal to a second
(Continued)

threshold, in which the second threshold is greater than or equal to the first threshold.

16 Claims, 4 Drawing Sheets

(56) References Cited

U.S. PATENT DOCUMENTS

| | | | | |
|---|---|---|---|---|
| 2008/0100274 | A1 | 5/2008 | Hayakawa | |
| 2008/0175402 | A1* | 7/2008 | Abe | G10K 11/178 381/71.6 |
| 2010/0215183 | A1* | 8/2010 | Hansson | H04R 1/1033 381/58 |
| 2012/0134503 | A1* | 5/2012 | Poulsen | H04R 29/004 381/58 |

FOREIGN PATENT DOCUMENTS

| | | |
|---|---|---|
| CN | 102300003 | 12/2011 |
| CN | 102780949 | 11/2012 |
| CN | 202721805 | 2/2013 |

* cited by examiner

METHOD AND DEVICE FOR AUTOMATICALLY IDENTIFYING MICROPHONE PIN AND GROUND PIN OF AUDIO INTERFACE AND ELECTRONIC SIGNATURE TOKEN

CROSS-REFERENCE TO RELATED APPLICATION

This application claims priority of Chinese Patent Application Serial No. 201210196122.3, filed with the State Intellectual Property Office of P. R. China on Jun. 13, 2012, the entire disclosure of which is incorporated by reference herein.

FIELD

The present disclosure generally relates to an electronic technical field, and more particularly relates to a method and a device for automatically indentifying a microphone pin and a ground pin of an audio interface, and an electronic signature token.

BACKGROUND

An audio interface (such as a headphone jack) of an existing audio signal sending apparatus (such as a mobile communication terminal) and an audio interface of an audio signal receiving apparatus (such as an electronic signature token, an audio signal adapter device, and other audio signal receiving apparatuses which receive and process audio signals via their audio output pins) generally use a four-section interface, in which a third pin and a fourth pin are audio output pins, i.e., a left-channel pin and a right-channel pin respectively. However, a first pin and a second pin of different types of audio interfaces play different roles, that is, there are two types of audio interfaces: the first pin is a MIC pin (a microphone pin) and the second pin is a GND pin (a ground pin); the first pin is a GND pin and the second pin is a MIC pin.

As different types of audio interfaces exist, when the ground pin of the audio interface of the audio signal sending apparatus is not connected with the ground pin of the audio interface of the audio signal receiving apparatus, the audio signal sending apparatus cannot communicate with the audio signal receiving apparatus normally.

Therefore, whether for designing the audio signal receiving apparatus which can be adaptively matched with different audio interfaces of the audio signal sending apparatus or prompting a user whether the audio interface is matched by using a voice or text prompt function of the audio signal receiving apparatus, the type of the audio interface should be firstly identified in the audio signal receiving apparatus, such that the type of the audio interface of the audio signal sending apparatus connected with the audio signal receiving apparatus can be identified.

Thus, a device which can automatically identify the type of the audio interface is needed.

SUMMARY

The present disclosure seeks to overcome at least one of the above defects.

For this, an objective of the present disclosure is to provide a method for automatically identifying a microphone pin and a ground pin of an audio interface.

Another objective of the present disclosure is to provide a device for automatically identifying a microphone pin and a ground pin of an audio interface.

Yet another objective of the present disclosure is to provide an electronic signature token.

To achieve the above objectives, embodiments of a first aspect of the present disclosure provide a method for automatically identifying a microphone pin and a ground pin of an audio interface. The audio interface comprises a first pin and a second pin, the first pin is one of the microphone pin and the ground pin of the audio interface, and the second pin is the other one of the microphone pin and the ground pin of the audio interface. The method comprises: not implementing an identification operation on the first pin and the second pin of the audio interface when an absolute value of a voltage difference between the first pin and the second pin is less than a first threshold; determining a type of each of the first pin and the second pin according to a sign of the voltage difference when the absolute value of the voltage difference between the first pin and the second pin is greater than or equal to a second threshold, in which the second threshold is greater than or equal to the first threshold. When the absolute value of the voltage difference is greater than or equal to the second threshold and the voltage difference is positive, the first pin is determined as the microphone pin and the second pin is determined as the ground pin. When the absolute value of the voltage difference is greater than or equal to the second threshold and the voltage difference is negative, the first pin is determined as the ground pin and the second pin is determined as the microphone pin.

Furthermore, when the second threshold is greater than the first threshold and the absolute value of the voltage difference is between the first threshold and the second threshold, the identification operation is not implemented on the first pin and the second pin of the audio interface, or the identification operation is implemented on the first pin and the second pin of the audio interface. When the identification operation is implemented on the first pin and the second pin of the audio interface, the type of each of the first pin and the second pin is determined according to the sign of the voltage difference.

Furthermore, the voltage difference is obtained by: measuring the voltage difference between the first pin and the second pin directly; or measuring voltage values of the first pin and the second pin with respect to a reference voltage, and calculating a difference value between the voltage values.

Furthermore, the voltage difference is compared with the first threshold or the second threshold via a triode, a comparator, a processor or a combination thereof.

Embodiments of a second aspect of the present disclosure provide a device for automatically identifying a microphone pin and a ground pin of an audio interface. The audio interface comprises a first pin and a second pin, the first pin is one of the microphone pin and the ground pin of the audio interface, and the second pin is the other one of the microphone pin and the ground pin of the audio interface. The device comprises a determining module. The determining module is configured to not implement an identification operation on the first pin and the second pin when an absolute value of a voltage difference between the first pin and the second pin is less than a first threshold, to determine a type of each of the first pin and the second pin according to a sign of the voltage difference when the absolute value of the voltage difference is greater than or equal to a second threshold, in which the second threshold is greater than the first threshold, the first pin is determined as the microphone pin and the second pin is determined as the ground pin when the absolute value of the voltage difference is greater than or equal to the second threshold and the voltage difference is positive, and the first pin is determined as the ground pin and the second pin is determined as the microphone pin when the absolute value of the voltage difference is greater than or equal to the second threshold and the voltage difference is negative.

Furthermore, when the second threshold is greater than the first threshold and the absolute value of the voltage difference is between the first threshold and the second threshold, the determining module is further configured to not implement the identification operation on the first pin and the second pin of the audio interface, or to implement the identification operation on the first pin and the second pin of the audio interface. When the identification operation is implemented on the first pin and the second pin of the audio interface, the type of each of the first pin and the second pin is determined according to the sign of the voltage difference.

Furthermore, the device further comprises a collecting module. The collecting module is connected with the first pin and the second pin of the audio interface respectively, and configured to collect voltage values of the first pin and the second pin or the voltage difference, and to send the voltage values or the voltage difference to the determining module.

Furthermore, the collecting module comprises a first collecting module and a second collecting module. A first end of the first collecting module is connected with the first pin of the audio interface to collect the voltage value of the first pin; a first end of the second collecting module is connected with the second pin of the audio interface to collect the voltage value of the second pin; and a second end of the first collecting module is connected with a first input end of the determining module, and a second end of the second collecting module is connected a second input end of the determining module, to send the collected voltage values to the determining module for comparing.

Furthermore, the determining module comprises a triode, a comparator, a processor or a combination thereof.

Furthermore, the processor comprises an analog-to-digital conversion module. The analog-to-digital conversion module is configured to convert voltages of the first pin and the second pin to digital voltage signals and to send the digital voltage signals to the determining module for comparing and identifying.

Embodiments of a third aspect of the present disclosure provide an electronic signature token comprising the above mentioned device for automatically indentifying the microphone pin and the ground pin of the audio interface.

According to embodiments of the present disclosure, the type of the audio interface can be determined only according to the output voltage values of the first pin and the second pin, thus achieving an automatic and accurate identification on the type of the audio interface at a low cost, and facilitating later use.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the accompanying drawings, in which.

DETAILED DESCRIPTION

Figure 1:
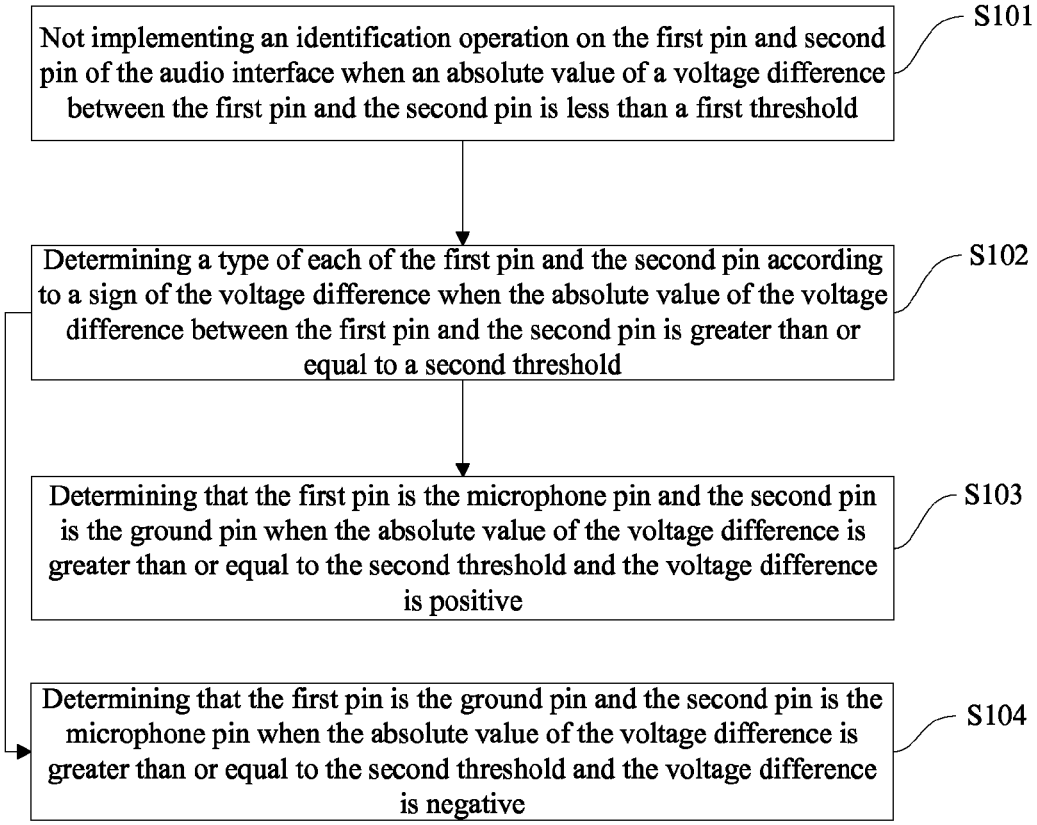
FIG. 1 is a flow chart of a method for automatically identifying a microphone pin and a ground pin of an audio interface according to a first embodiment of the present disclosure.

Reference will be made in detail to embodiments of the present disclosure. Embodiments of the present disclosure will be shown in drawings, in which the same or similar elements and the elements having same or similar functions are denoted by like reference numerals throughout the descriptions. The embodiments described herein according to drawings are explanatory and illustrative, not construed to limit the present disclosure.

It is to be understood that phraseology and terminology used herein with reference to device or element orientation (such as, terms like "center", "longitudinal", "lateral", "up", "down", "front", "rear", "left", "right", "vertical", "horizontal", "top", "bottom", "inside", "outside") are only used to simplify description of the present disclosure, and do not indicate or imply that the device or element referred to must have or operated in a particular orientation. They cannot be seen as limits to the present disclosure. Moreover, terms of "first" and "second" are only used for description and cannot be seen as indicating or implying relative importance. Further, "first pin" and "second pin" are only used for distinguishing pins and not used for defining positions of the pins.

In the description of the present disclosure, it is to be explained that terms of "installation", "linkage" and "connection" shall be understood broadly, for example, it could be permanent connection, removable connection or integral connection; it could be mechanical connection or electric connection; it could be direct linkage, indirect linkage or inside linkage within two elements. Those skilled in the art shall understand the concrete notations of the terms mentioned above according to specific circumstances.

In the following, a method and a device for automatically identifying a microphone pin and a ground pin of an audio interface and an electronic signature token according to embodiments of the present disclosure will be described in detail with reference to drawings.

In embodiments of the present disclosure, the audio interface comprises a first pin and a second pin. In specific examples of the present disclosure, the first pin and the second pin of the audio interface are defined as follows: the first pin is one of a MIC pin (microphone pin) and a GND pin (ground pin) of the audio interface, and the second pin is the other one of the MIC pin and the GND pin of the audio interface.

In embodiments of the present disclosure, the audio interface may be any four-section headphone plug or headphone jack, such as the headphone plug or headphone jack with a diameter of 3.5 mm or 2.5 mm.

When the audio interface in the present disclosure is the headphone plug, the audio interface of the identification apparatus according to the present disclosure can be inserted into a headphone jack of an audio signal sending apparatus (for example, a mobile terminal) directly. When the audio interface in the present disclosure is the headphone jack, it can be connected with the headphone jack of the audio signal sending apparatus via an adapter cable having two headphone plugs at two ends thereof.

First Embodiment

FIG. 1 is a flow chart of a method for automatically identifying a microphone pin and a ground pin of an audio interface. Referring to FIG. 1, the method comprises following steps.

At step S101, an identification operation is not implemented on the first pin and the second pin of the audio interface when an absolute value of a voltage difference between the first pin and the second pin is less than a first threshold.

At step S102, a type of each of the first pin and the second pin is determined according to a sign of the voltage difference when the absolute value of the voltage difference between the first pin and the second pin is greater than or equal to a second threshold.

The second threshold is greater than or equal to the first threshold. Specifically, the first threshold generally ranges from 0 to 1V, preferably, the first threshold ranges from 0.4V to 0.6V, and further, the first threshold may be 0.5V. The second threshold generally ranges from 0 to 1.5V, preferably, the second threshold ranges from 0.6V to 0.8V, and further, the second threshold may be 0.7V.

At step S103, the first pin is determined as the microphone pin and the second pin is determined as the ground pin when the absolute value of the voltage difference is greater than or equal to the second threshold and the voltage difference is positive (for example, when the voltage difference is greater than 0.7V).

At step S104, the first pin is determined as the ground pin and the second pin is determined as the microphone pin when the absolute value of the voltage difference is greater than or equal to the second threshold and the voltage difference is negative (for example, when the voltage difference is less than −0.7V).

Specifically, when the second threshold is greater than the first threshold and the absolute value of the voltage difference is between the first threshold and the second threshold, the identification operation is not implemented on the first pin and the second pin of the audio interface; or the identification operation is implemented on the first pin and the second pin of the audio interface, i.e., the type of each of the first pin and the second pin is determined according to the sign of the voltage difference.

According to embodiments of the present disclosure, the type of the audio interface can be determined only according to the output voltage values of the first pin and the second pin, thus achieving an automatic and accurate identification on the type of the audio interface at a low cost and facilitating later use.

Certainly, in this embodiment, the voltage difference can be obtained by following means: measuring the voltage difference between the first pin and the second pin directly; or measuring voltage values of the first pin and the second with respect to a reference voltage respectively and calculating a difference value between the voltage values.

In this embodiment, the type of the audio interface can be determined in hardware or software.

When the type of the audio interface is determined in hardware, the voltage difference can be compared with the first threshold or the second threshold via a triode and/or a comparator, so as to determine the type of the audio interface.

When the type of the audio interface is determined in software, the voltage difference can be calculated via a processor. Certainly, the processor may comprise an analog-to-digital conversion module and/or a processing module.

Certainly, the type of the audio interface can be determined by means of a combination of hardware and software.

In conclusion, with the method for automatically identifying the microphone pin and the ground pin of the audio interface according to embodiments of the present disclosure, the type of the audio interface can be detected accurately at a low cost, and subsequent processing can be proceeded after determining the type of the audio interface.

Second Embodiment

Figure 2:
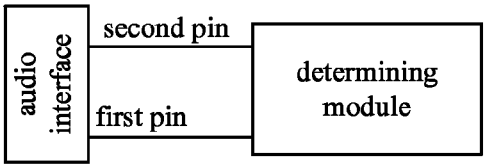
FIG. 2 is a schematic diagram of a device for automatically identifying a microphone pin and a ground pin of an audio interface according to a second embodiment of the present disclosure.

FIG. 2 is a schematic diagram of a device for automatically identifying a microphone pin and a ground pin of an audio interface according to a second embodiment of the present disclosure. Referring to FIG. 2, the device for automatically identifying the microphone pin and the ground pin of the audio interface comprises a determining module. The determining module is configured to not implement an identification operation on the first pin and the second pin of the audio interface when the absolute value of the voltage difference between the first pin and the second pin is less than a first threshold, and to determine a type of each of the first pin and the second pin of the audio interface according to the sign of the voltage difference when the absolute value of the voltage difference between the first pin and the second pin is greater than or equal to a second threshold, in which the second threshold is greater than or equal to the first threshold, the first pin is determined as the microphone pin and the second pin is determined as the ground pin when the absolute value of the voltage difference is greater than or equal to the second threshold and the voltage difference is positive, and the first pin is determined as the ground pin and the second pin is determined as the microphone pin when the absolute value of the voltage difference is greater than or equal to the second threshold and the voltage difference is negative.

Certainly, when the second threshold is greater than the first threshold and the absolute value of the voltage difference is between the first threshold and the second threshold, the determining module is further configured to not implement the identification operation on the first pin and the second pin of the audio interface, or to implement the identification operation on the first pin and the second pin of the audio interface, i.e., determine the type of each of the first pin and the second pin of the audio interface according to the sign of the voltage difference.

Specifically, the first threshold generally ranges from 0 to 1V, preferably, the first threshold ranges from 0.4V to 0.6V, and further, the first threshold may be 0.5V. The second threshold generally ranges from 0 to 1.5V, preferably, the second threshold ranges from 0.6V to 0.8V, and further, the second threshold may be 0.7V.

With the device according to embodiments of the present disclosure, the type of the audio interface can be determined only according to the output voltage values of the first pin and the second pin, thus achieving an automatic and accurate identification on the type of the audio interface at a low cost and facilitating later use.

Third Embodiment

Figure 3:
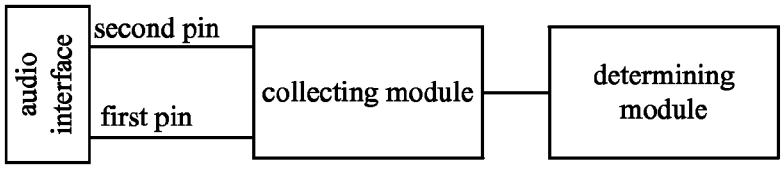
FIG. 3 is a first schematic diagram of a device for automatically identifying a microphone pin and a ground pin of an audio interface according to a third embodiment of the present disclosure.

FIG. 3 shows a schematic diagram of a device for automatically identifying a microphone pin and a ground pin of an audio interface according to a third embodiment of the present disclosure. Referring to FIG. 3, based on the second embodiment, the device in the third embodiment further comprises a collecting module. The collecting module is connected with the first pin and the second pin of the audio interface respectively and configured to collect voltage values of the first pin and the second pin or collect the voltage difference, and to send the voltage values or the voltage difference to the determining module.

Figure 4:
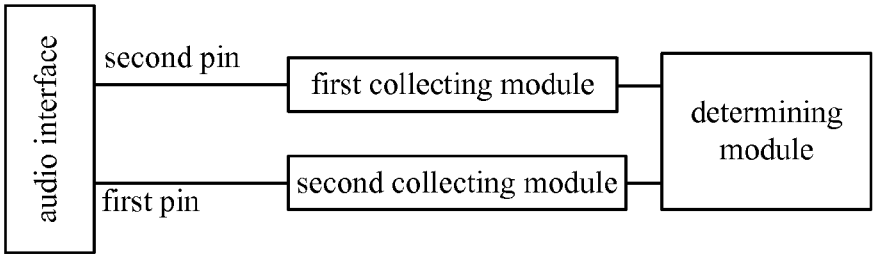
FIG. 4 is a second schematic diagram of a device for automatically identifying a microphone pin and a ground pin of an audio interface according to the third embodiment of the present disclosure.

Further, referring to FIG. 4, the collecting module may comprise a first collecting module and a second collecting module. A first end of the first collecting module is connected with the first pin of the audio interface to collect the voltage value of the first pin. A first end of the second collecting module is connected with the second pin of the audio interface to collect the voltage value of the second pin. A second end of the first collecting module is connected with a first input end of the determining module, and a second end of the second collecting module is connected with a second input end of the determining module, to send the collected voltage values to the determining module for comparing.

Certainly, functions of the determining module of the present disclosure may be as achieved by a processor, or by a comparator and/or a triode. Moreover, functions of the determining module may be achieved by means of a combination of hardware and software.

The details are explained in the fourth embodiment and the fifth embodiment.

Fourth Embodiment

Figure 5:
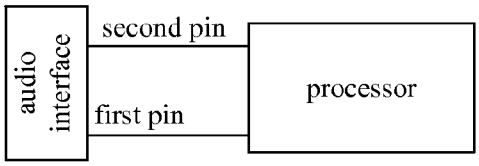
FIG. 5 is a first schematic diagram of a device for automatically identifying a microphone pin and a ground pin of an audio interface according to a fourth embodiment of the present disclosure.

FIG. 5 is a schematic diagram of a device for automatically identifying a microphone pin and a ground pin of an audio interface according to a fourth embodiment of the present disclosure. Referring to FIG. 5, functions of the determining module may be as achieved by a processor, i.e. the processor is connected with the first pin and the second pin directly and configured to identify the type of the first pin and the second pin.

Figure 6:
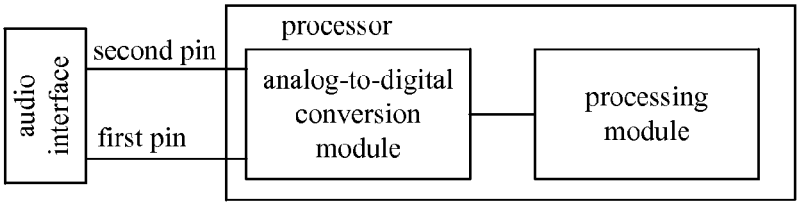
FIG. 6 is a second schematic diagram of a device for automatically identifying a microphone pin and a ground pin of an audio interface according to the fourth embodiment of the present disclosure.

The determining module may be implemented as shown in FIG. 6, in which the processor may comprise an analog-to-digital conversion module and a processing module. The analog-to-digital conversion module is configured to convert the voltage values of the first pin and the second pin to digital signals and to send the digital signals to the processing module for identifying.

Figure 7:
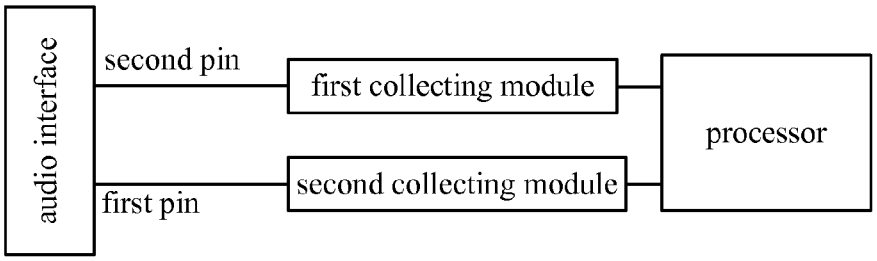
FIG. 7 is a third schematic diagram of a device for automatically identifying a microphone pin and a ground pin of an audio interface according to the fourth embodiment of the present disclosure.

The determining module may also be implemented as shown in FIG. 7, in which the voltage values of the first pin and the second pin are collected by the first collecting module and the second collecting module, and then sent to the processor directly for comparing and identifying.

Figure 8:
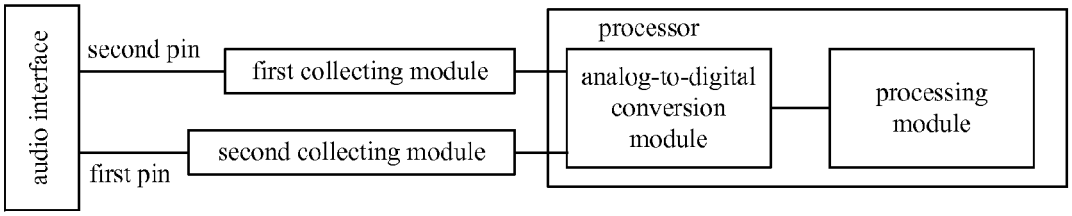
FIG. 8 is a fourth schematic diagram of a device for automatically identifying a microphone pin and a ground pin of an audio interface according to the fourth embodiment of the present disclosure.

Certainly, the determining module may also be implemented as shown in FIG. 8, in which the voltage values of the first pin and the second pin are collected by the first collecting module and the second collecting module and converted to digital voltage signals by the analog-to-digital conversion module, and then the digital voltage signals are sent to the processing module for comparing and identifying.

Fifth Embodiment

Figure 9:
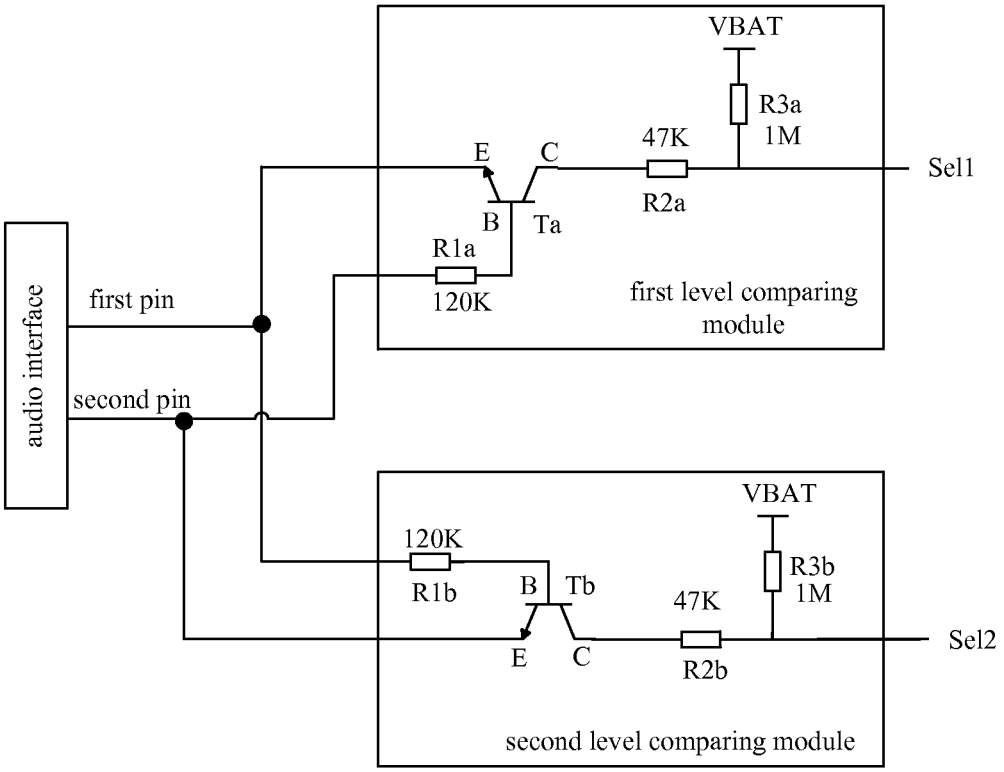
FIG. 9 is a first schematic diagram of a device for automatically identifying a microphone pin and a ground pin of an audio interface according to a fifth embodiment of the present disclosure.

FIG. 9 is a schematic diagram of a device for automatically identifying a microphone pin and a ground pin of an audio interface according to a fifth embodiment of the present disclosure. Referring to FIG. 9, the determining module adopts the triode to compare the voltage of the first pin with that of the second pin. In the embodiment shown in FIG. 9, the determining module may comprise a first level comparing module and a second level comparing module. Specifically, the determining module may be configured to have some triodes.

The first level comparing module comprises a NPN-type triode Ta, a power output terminal (VBAT) and a resistor R3*a*. Furthermore, the first level comparing module may further comprise resistors R1*a* and R2*a*.

When an ordinary battery is used as the power source, a voltage output from the power output terminal generally ranges from 2.7V to 4.2V.

A resistance of the resistor R3*a* may range from 100KΩ to 1MΩ.

A resistance of the resistor R2*a* may range from one tenth of the resistance of the resistor R3*a* to one fifth of the resistance of the resistor R3*a*.

A resistance of the resistor R1*a* may range from 1KΩ to 200KΩ.

A base (B) of the triode Ta is connected with the second pin, an emitter (E) of the triode Ta is connected with the first pin, and a collector (C) of the triode Ta is connected with an output terminal (Sel1) of the first level comparing module and connected with the power output terminal (VBAT) via the resistor R3*a*.

In the first level comparing module, the base (B) of the triode Ta can be connected with the second pin via the resistor R1*a*, the output terminal (Sel1) can be connected with the collector (C) of the triode Ta via the resistor R2*a*, and the collector (C) of the triode Ta can be connected with the power output terminal (VBAT) via the resistors R2*a* and R3*a* in sequence.

The second level comparing module comprises a NPN-type triode Tb, a power output terminal (VBAT) and a resistor R3*b*. Furthermore, the second level comparing module may further comprise a resistor R1*b* and a resistor R2*b*.

When an ordinary battery is used as the power source, a voltage output from the power output terminal generally ranges from 2.7V to 4.2V.

A resistance of the resistor R3*b* may range from 100KΩ to 1MΩ.

A resistance of the resistor R2*b* may range from one tenth of the resistance of the resistor R3*b* to one fifth of the resistance of the resistor R3*b*.

A resistance of the resistor R1*b* may range from 1KΩ to 200KΩ.

A base (B) of the triode Tb is connected with the first pin, an emitter (E) of the triode Tb is connected with the second pin, and a collector (C) of the triode Tb is connected with an output terminal (Sel2) of the second level comparing module and connected with the power output terminal (VBAT) via the resistor R3*b*.

In the second level comparing module, the base (B) of the triode Tb can be connected with the first pin via the resistor Rib, the output terminal (Sel2) can be connected with the collector (C) of the triode Tb via the resistor R2*b*, and the collector (C) of the triode Tb can be collected with the power output terminal (VBAT) via the resistors R2*b* and R3*b* in sequence.

In this embodiment, when the triode Ta is turned off, the power output terminal (VBAT) of the first level comparing module is connected with the output terminal (Sel1) via the resistor R3*a*, and a high level signal is output from the output terminal (Sel1); when the triode Tb is turned off, the power output terminal (VBAT) of the second level comparing module is connected with the output terminal (Sel2) via the resistor R3*b*, and a high level signal is output from the output terminal (Sel2).

When a level V3 of the first pin is greater than a sum of a level V4 of the second pin and a threshold Vg (i.e. V3>V4+Vg), the triode Tb in the second level comparing module is turned on, the triode Tb is turned on, a low level signal (first indication signal, denoted as Sg1) is output from the output terminal (Sel2), which indicates that the first pin is the microphone pin and the second pin is the ground pin; otherwise, the second level comparing module outputs the high level signal (denotes as Sg1').

When the level V4 of the second pin is greater than a sum of the level V3 of the first pin and the threshold Vg (i.e. V4>V3+Vg), the triode Ta in the first level comparing module is turned on, a low level signal (second indication signal, denoted as Sg2) is output from the output terminal (Sel1), which indicates that the first pin is the ground pin and the second pin is the microphone pin; otherwise, the first level comparing module outputs the high level signal (denotes as Sg2').

In this embodiment, the threshold Vg may be a break-over voltage of the triode Ta, such as 0.3V or 0.7V.

The above "high level signal" refers to a signal whose voltage is higher than that of the "low level signal"; generally, the "low level signal" refers to a signal whose voltage is below 0.7V; the "high level signal" refers to a signal whose voltage is 0.7 times the power voltage.

Based on this, the types of the first pin and the second pin can be determined according to the high level signal or low level signal output from the first level comparing module and the second level comparing module.

Figure 10:
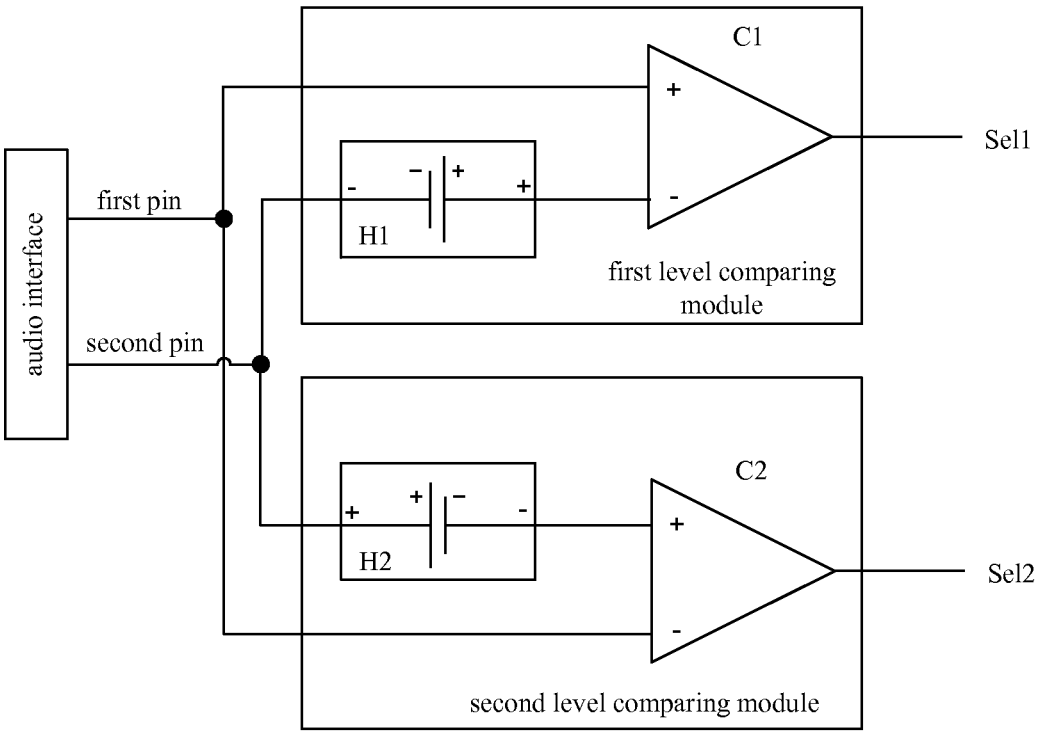
FIG. 10 is a second schematic diagram of a device for automatically identifying a microphone pin and a ground pin of an audio interface according to the fifth embodiment of the present disclosure.

In this embodiment, the determining module may also be implemented as shown in FIG. 10. Referring to FIG. 10, the determining module adopts comparators to compare the voltage of the first pin with the voltage of the second pin.

The first level comparing module comprises a first reference voltage module H1 and a comparator C1.

The first pin is connected with a positive terminal of the comparator C1, the second pin is connected with a negative terminal of the comparator C1 via the first reference voltage module H1, i.e. the second pin is connected with a negative terminal of the first reference voltage module H1, and a positive terminal of the first reference voltage module H1 is connected with the negative terminal of the comparator C1.

In this embodiment, the first reference voltage module H1 may be a power source, a positive pole of the power source is the positive terminal of the first reference voltage module H1, and a negative pole of the power source is the negative terminal of the first reference voltage module H1. The voltage value provided by the first reference voltage module H1 is the threshold Vg.

In other embodiments of the present disclosure, the first reference voltage module H1 may be an element connected with the power source and adapted for providing the reference voltage (threshold voltage), such as a diode.

An output pin of the comparator C1 is the output terminal (Sel1) of the first level comparing module.

The second level comparing module comprises a second reference voltage module H2 and a comparator C2.

The first pin is connected with a negative terminal of the comparator C2, the second pin is connected with a positive terminal of the comparator C2 via the second reference voltage module H2, i.e. the second pin is connected with a positive terminal of the second reference voltage module H2, and a negative terminal of the second reference voltage module H2 is connected with the positive terminal of the comparator C2.

In this embodiment, the second reference voltage module H2 may be a power source, a positive pole of the power source is the positive terminal of the second reference voltage module H2, and a negative pole of the power source is the negative terminal of the second reference voltage module H2. The voltage value provided by the second reference voltage module H2 is the threshold Vg.

In other embodiments of the present disclosure, the second reference voltage module H2 may be an element connected with the power source and adapted for providing the reference voltage (threshold voltage), such as a diode.

In this embodiment, when the level V3 of the first pin is higher than a sum of the level V4 of the second pin and the threshold Vg (i.e. V3>V4+Vg), the comparator C1 of the first level comparing module outputs a high level signal (first indication signal, denoted as Sg1) via the output terminal (Sel1), which indicates that the first pin is the microphone pin and the second pin is the ground pin; otherwise, the first level comparing module outputs a low level signal (denoted as Sg1').

When the level V4 of the second pin is higher than a sum of the level V3 of the first pin and the threshold Vg (i.e. V4>V3+Vg), the comparator C2 of the second level comparing module outputs a high level signal (second indication signal, denoted as Sg2) via the output terminal (Sel2), which indicates that the first pin is the ground pin and the second pin is the microphone pin; otherwise, the second level comparing module outputs a low level signal (denoted as Sg2').

Based on this, the types of the first pin and the second pin can be determined according to the high level signal or low level signal output from the first level comparing module and the second level comparing module.

Figure 11:
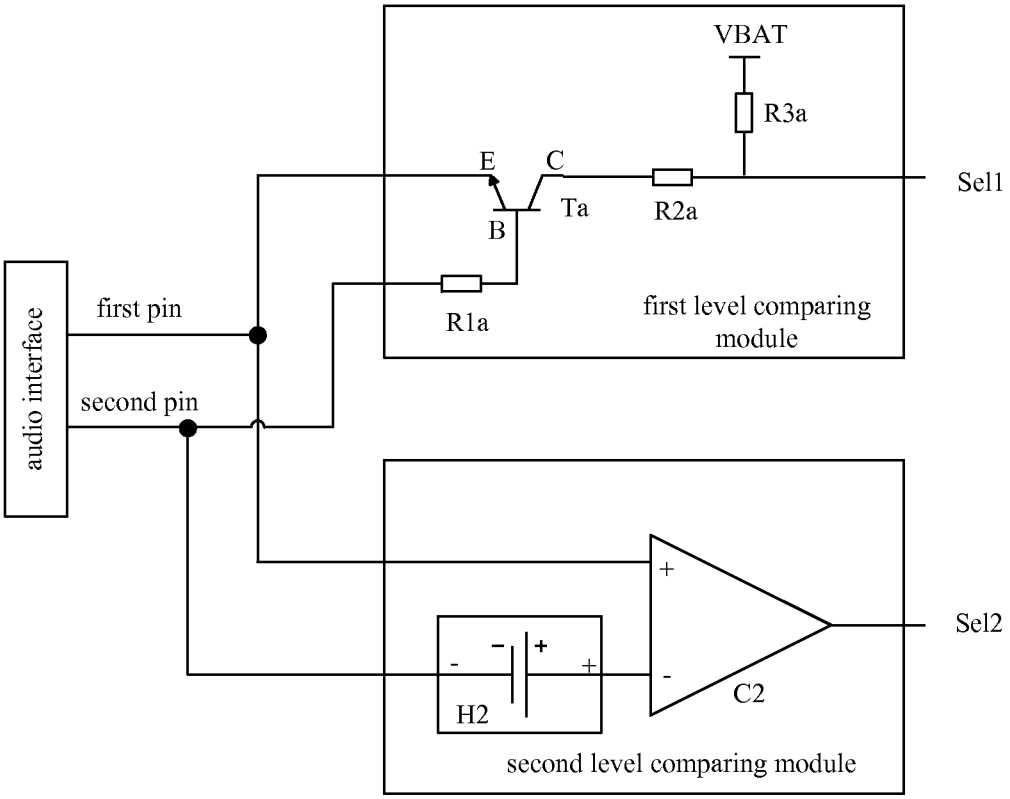
FIG. 11 is a third schematic diagram of a device for automatically identifying a microphone pin and a ground pin of an audio interface according to the fifth embodiment of the present disclosure.

Certainly, in this embodiment, the determining module may also be implemented as shown in FIG. 11. Referring to FIG. 11, the determining module adopts triodes and comparators to compare the voltage of the first pin with the voltage of the second pin.

Referring to FIG. 11, the first level comparing module comprises a NPN-type triode Ta, a power output terminal (VBAT), a resistor R3*a*. Furthermore, the first level comparing module may further comprise a resistor R1*a* and a resistor R2*a*.

A base (B) of the triode Ta is connected with the second pin, an emitter (E) of the triode Ta is connected with the first pin, and a collector (C) of the triode Ta is connected with an output terminal (Sel1) of the first level comparing module and connected with the power output terminal (VBAT) via the resistor R3*a*.

In the first level comparing module, the base (B) of the triode Ta can be connected with the second pin via the resistor R1*a*, the output terminal (Sel1) can be connected with the collector (C) of the triode Ta via the resistor R2*a*, and the collector (C) of the triode Ta can be connected with the power output terminal (VBAT) via the resistors R2*a* and R3*a*.

Certainly, the first level comparing module in this embodiment may be replaced with the first level comparing module in the second embodiment.

The second level comparing module comprises a second reference voltage module H2 and a comparator C2.

The first pin is connected with a positive terminal of the comparator C2, the second pin is connected with a negative terminal of the comparator C2 via the second reference voltage module H2, i.e. the second pin is connected with a negative terminal of the second reference voltage module H2, and a positive terminal of the second reference voltage module H2 is connected with the negative terminal of the comparator C2.

In this embodiment, the second reference voltage module H2 may be a power source, a positive pole of the power source is the positive terminal of the second reference voltage module H2, and a negative pole of the power source is the negative terminal of the second reference voltage module H2. The voltage value provided by the second reference voltage module H2 is the threshold Vg.

In other embodiments of the present disclosure, the second reference voltage module H2 may be an element connected with the power source and adapted for providing the reference voltage (threshold voltage), such as a diode.

An output pin of the comparator C2 is the output terminal (Sel2) of the second level comparing module.

In this embodiment, when the level V3 of the first pin is higher than a sum of the level V4 of the second pin and the threshold Vg (i.e. V3>V4+Vg), the comparator C2 of the second level comparing module outputs a high level signal (first indication signal, denoted as Sg1) via the output terminal (Sel2), which indicates that the first pin is the microphone pin and the second pin is the ground pin; otherwise, the second level comparing module outputs a low level signal (denoted as Sg1').

When the level V4 of the second pin is higher than a sum of the level V3 of the first pin and the threshold Vg (i.e. V4>V3+Vg), the triode Ta of the first level comparing module is turned on, and a low level signal (second indication signal, denoted as Sg2) is output from the output terminal (Sel1), which indicates that the first pin is the ground pin and the second pin is the microphone pin; otherwise, the first level comparing module outputs a high level signal (denoted as Sg2').

In this embodiment, the threshold Vg may be a break-over voltage of the triode Ta, such as 0.3V or 0.7V.

In conclusion, according to the devices shown in FIGS. 9-11, two level comparing modules (denoted as level comparing module A and level comparing module B) are provided. When the level of the first pin is higher than the level of the second pin to a certain degree, the level comparing module A sends signal Sg1, otherwise the level comparing module A sends signal Sg1'. When the level of the second pin is higher than the level of the first pin to a certain degree, the level comparing module B sends signal Sg2, otherwise the level comparing module B sends signal Sg2'. Thus, the device for detecting the type of the audio interface according to the present disclosure may provide following three states.

State 1: the level comparing module A sends signal Sg1 (indicating that V3>V4+Vg1), and the level comparing module B sends signal Sg2' (indicating that V4≤V3+Vg2); i.e. the first pin is the microphone pin.

State 2: the level comparing module A sends signal Sg1' (indicating that V3≤V4+Vg1), and the level comparing module B sends signal Sg2 (indicating that V4>V3+Vg2); i.e. the second pin is the microphone pin.

State 3: the level comparing module A sends signal Sg1' (indicating that V3≤V4+Vg1), and the level comparing module B sends signal Sg2' (indicating that V4≤V3+Vg2); i.e. the types of the first pin and the second pin cannot be determined.

Thus, according to embodiments of the present disclosure, the type of the audio interface can be determined accurately at a low cost.

Sixth Embodiment

Embodiments of the present disclosure further provide an electronic signature token. The electronic signature token comprises the device for automatically identifying the microphone pin and the ground pin of the audio interface described in any above embodiment.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the above phrases in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A method for automatically identifying a microphone pin and a ground pin of an audio interface, wherein the audio interface comprises a first pin and a second pin, the first pin is one of the microphone pin and the ground pin of the audio interface, the second pin is the other one of the microphone pin and the ground pin of the audio interface, the audio interface is connected with a headphone jack of a mobile terminal, and the method comprises:

not implementing an identification operation on the first pin and the second pin of the audio interface if an absolute value of a voltage difference between the first pin and the second pin is less than a first threshold;

determining a type of each of the first pin and the second pin according to a sign of the voltage difference between the first pin and the second pin if the absolute value of the voltage difference is greater than or equal to a second threshold, in which, the second threshold is greater than or equal to the first threshold, if the absolute value of the voltage difference is greater than or equal to the second threshold and the voltage difference is positive, the first pin is determined as the microphone pin and the second pin is determined as the ground pin, and if the absolute value of the voltage difference is greater than or equal to the second threshold and the voltage difference is negative, the first pin is determined as the ground pin and the second pin is determined as the microphone pin.

2. The method according to claim 1, further comprising: if the second threshold is greater than the first threshold and the absolute value of the voltage difference is between the first threshold and the second threshold, not implementing the identification operation on the first pin and the second pin of the audio interface; or implementing the identification operation on the first pin and the second pin of the audio interface, in which the type of each of the first pin and the second pin is determined according to the sign of the voltage difference.

3. The method according to claim 1, wherein the voltage difference is obtained by:

measuring the voltage difference between the first pin and the second pin directly; or measuring voltage values of the first pin and the second pin with respect to a reference voltage, and calculating a difference value between the voltage values.

4. The method according to claim 3, wherein the voltage difference is compared with the first threshold or the second threshold via a triode, a comparator, a processor or a combination thereof.

5. A device for automatically identifying a microphone pin and a ground pin of an audio interface, wherein the audio interface comprises a first pin and a second pin, the first pin is one of the microphone pin and the ground pin of the audio interface, the second pin is the other one of the microphone pin and the ground pin of the audio interface, the audio interface is connected with a headphone jack of a mobile terminal, and the device comprises a determining circuit, the determining circuit is configured to not implement an identification operation on the first pin and the second pin if an absolute value of a voltage difference between the first pin and the second pin is less than a first threshold, and to determine a type of each of the first pin and the second pin according to a sign of the voltage difference if the absolute value of the voltage difference is greater than or equal to a second threshold, in which the second threshold is greater than or equal to the first threshold, the first pin is determined as the microphone pin and the second pin is determined as the ground pin if the absolute value of the voltage difference is greater than or equal to the second threshold and the voltage difference is positive, and the first pin is determined as the ground pin and the second pin is determined as the microphone pin if the absolute value of the voltage difference is greater than or equal to the second threshold and the voltage difference is negative.

6. The device according to claim 5, wherein if the second threshold is greater than the first threshold and the absolute value of the voltage difference is between the first threshold and the second threshold, the determining circuit is further configured to not implement the identification operation on the first pin and the second pin of the audio interface, or to implement the identification operation on the first pin and the second pin of the audio interface, in which the type of each of the first pin and the second pin of the audio interface is determined according to the sign of the voltage interface when the identification operation is implemented on the first pin and the second pin of the audio interface.

7. The device according to claim 5, further comprising:

a collecting circuit, connected with the first pin and the second pin of the audio interface respectively, and configured to collect voltage values of the first pin and the second pin respectively or the voltage difference of the first pin and the second, and to send the voltage values or the voltage difference to the determining circuit.

8. The device according to claim 7, wherein the collecting circuit comprises a first collecting circuit and a second collecting circuit, a first end of the first collecting circuit is connected with the first pin of the audio interface to collect the voltage value of the first pin;

a first end of the second collecting circuit is connected with the second pin of the audio interface to collect the voltage value of the second pin; and a second end of the first collecting circuit is connected with a first input end of the determining circuit, and a second end of the second collecting circuit is connected with a second input end of the determining circuit, to send the collected voltage values to the determining circuit for comparing.

9. The device according to claim 5, wherein the determining circuit comprises a triode, a comparator, a processor or a combination thereof.

10. The device according to claim 9, wherein the processor comprises an analog-to-digital conversion circuit configured to convert voltages of the first pin and the second pin to digital voltage signals and to send the digital voltage signals to the determining circuit for comparing and identifying.

11. An electronic signature token, comprising a device for automatically identifying a microphone pin and a ground pin of an audio interface, wherein the audio interface comprises a first pin and a second pin, the first pin is one of the microphone pin and the ground pin of the audio interface, the second pin is the other one of the microphone pin and the ground pin of the audio interface, the audio interface is connected with a headphone jack of a mobile terminal, and the device comprises a determining circuit, the determining circuit is configured to not implement an identification operation on the first pin and the second pin if an absolute value of a voltage difference between the first pin and the second pin is less than a first threshold, and to determine a type of each of the first pin and the second pin according to a sign of the voltage difference if the absolute value of the voltage difference is greater than or equal to a second threshold, in which the second threshold is greater than or equal to the first threshold, the first pin is determined as the microphone pin and the second pin is determined as the ground pin if the absolute value of the voltage difference is greater than or equal to the second threshold and the voltage difference is positive, and the first pin is determined as the ground pin and the second pin is determined as the microphone pin if the absolute value of the voltage difference is greater than or equal to the second threshold and the voltage difference is negative.

12. The electronic signature token according to claim 11, wherein if the second threshold is greater than the first threshold and the absolute value of the voltage difference is between the first threshold and the second threshold, the determining circuit is further configured to not implement the identification operation on the first pin and the second pin of the audio interface, or to implement the identification operation on the first pin and the second pin of the audio interface, in which the type of each of the first pin and the second pin of the audio interface is determined according to the sign of the voltage interface when the identification operation is implemented on the first pin and the second pin of the audio interface.

13. The electronic signature token according to claim 11, wherein the device further comprises:

a collecting circuit, connected with the first pin and the second pin of the audio interface respectively, and configured to collect voltage values of the first pin and the second pin respectively or the voltage difference of the first pin and the second, and to send the voltage values or the voltage difference to the determining circuit.

14. The electronic signature token according to claim 13, wherein the collecting circuit comprises a first collecting circuit and a second collecting circuit, a first end of the first collecting circuit is connected with the first pin of the audio interface to collect the voltage value of the first pin;

a first end of the second collecting circuit is connected with the second pin of the audio interface to collect the voltage value of the second pin; and a second end of the first collecting circuit is connected with a first input end of the determining circuit, and a second end of the second collecting circuit is connected with a second input end of the determining circuit, to send the collected voltage values to the determining circuit or comparing.

15. The electronic signature token according to claim 11, wherein the determining circuit comprises a triode, a comparator, a processor or a combination thereof.

16. The electronic signature token according to claim 15, wherein the processor comprises an analog-to-digital circuit configured to convert voltages of the first pin and the second pin to digital voltage signals and to send the digital voltage signals to the determining circuit for comparing and identifying.

* * * * *